United States Patent [19]

Guarnori

[11] Patent Number: 4,875,648

[45] Date of Patent: Oct. 24, 1989

[54] ASSEMBLY COMPRISING ROLLING MEANS AND SLIDEWAYS, AND LIGHTING APPARATUS COMPRISING SUCH AN ASSEMBLY

[75] Inventor: Manuel Guarnori, Chene-Bourg, Switzerland

[73] Assignee: Roland Racine, Thonex, Switzerland

[21] Appl. No.: 176,745

[22] Filed: Apr. 1, 1988

[30] Foreign Application Priority Data

Apr. 1, 1987 [CH] Switzerland ..... 1243/87

[51] Int. Cl.[4] ..... A47G 29/00

[52] U.S. Cl. ..... 248/125; 362/418

[58] Field of Search ..... 362/346, 391, 417, 418, 362/430, 368, 370, 371, 431, 451; 248/125, 295.1; 254/390, 393

[56] References Cited

U.S. PATENT DOCUMENTS

| | | | |
|---|---|---|---|
| 505,060 | 9/1893 | Mills | 362/427 |
| 507,364 | 10/1893 | Hiler | 362/418 |
| 1,459,249 | 6/1923 | Perkins | 362/451 |
| 1,959,172 | 5/1934 | McIlrath | 362/431 |
| 2,692,748 | 10/1954 | Anderson | 248/125 |
| 2,740,039 | 3/1956 | Phillips | 362/427 |
| 3,686,498 | 8/1972 | Meyer | 362/431 |
| 3,748,463 | 7/1973 | Trassinelli | 362/269 |
| 4,139,884 | 2/1979 | Thompson | 362/431 |
| 4,316,238 | 2/1982 | Booty et al. | 362/391 |
| 4,441,145 | 4/1984 | Antkowiak | 362/430 |
| 4,758,935 | 7/1988 | Frassati et al. | 362/430 |

FOREIGN PATENT DOCUMENTS

| | | | |
|---|---|---|---|
| 878075 | 8/1971 | Canada | 362/418 |

*Primary Examiner*—Stephen F. Husar

*Attorney, Agent, or Firm*—Young & Thompson

[57] ABSTRACT

The invention relates to an assembly comprising a rolling device and two parallel guiding slideways, in which the slideways (1, 2) are constituted by cylindrical elements of different diameters. The rolling device (3) comprises an axle of rotation (4) perpendicular to the plane of the two slideways and mounted displaceably parallel between these latter, a central roller (5) mounted freely rotatably on the axle and whose diameter is such that its periphery will be in rolling contact with the slideway (2) of smaller diameter, but out of contact with the other slideway, and two outer rollers (6) freely rotatably mounted on the axle of each side of the central roller, and whose peripheral internal surface comprises a concave groove (10) in rolling contact with the slideway (1) of greater diameter, but out of contact with the other slideway. This assembly may be used particularly in lighting apparatus.

1 Claim, 1 Drawing Sheet

ASSEMBLY COMPRISING ROLLING MEANS AND SLIDEWAYS, AND LIGHTING APPARATUS COMPRISING SUCH AN ASSEMBLY

The present invention relates to an assembly comprising rolling means and slideways, and lighting apparatus comprising such an assembly.

When mechanically effecting relative displacement, there are known numerous types of devices, for example with elements sliding on each other, with rails and rollers, etc. The aim of this invention consists in providing a new type of mechanism for such movements of relative displacement, which will be simple, reliable, precise and adaptable to numerous applications in different technical fields.

The accompanying drawing illustrates the invention schematically and by way of example.

Figure 1:
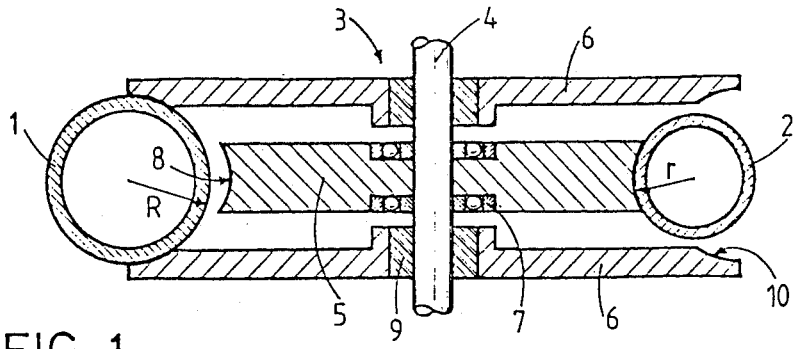
FIG. 1 is a cross sectional view of the assembly according to the invention.

Referring first to FIG. 1, the assembly according to the invention comprises two slideways or parallel guide elements 1, 2, which are here constituted by two tubes, of which one (1) has a radius R greater than the radius r of the other (2).

The assembly also comprises a rolling device 3, constituted by an axle of rotation 4 on which are mounted freely turnably a central roller 5 and two outer rollers 6.

Central roller 5 is mounted on the axle of rotation 4 by means of a roller bearing 7. The diameter of this central roller 5 is such that its periphery, more particularly the rounded groove 8, will be in contact with the external cylindrical surface of the smaller diameter slideway 2 so as to be able to roll on the same.

The two outer rollers 6 are mounted on the axle of rotation 4 by means of a bearing 9, for example in plastic material. Each outer roller 6 has on its periphery a concave portion 10 which is in contact with the outer cylindrical surface of the slideway of greater diameter 1 so as to be able to roll on this latter.

The different elements constituting the assembly according to the invention may be made of any material, for example metal (steel, brass, aluminum, etc.) or a suitable plastic material. It can be used for numerous applications in different fields, for example for medical or paramedical instruments, mechanical or micromechanical devices, particularly for modeling, pieces of furniture, particularly slidable drawers and doors, etc.

However, one of the particularly interesting applications of the assembly according to the invention, is constituted by lighting devices in which a light source is fixedly mounted for movement on the rolling device and the two slideways serve as means for supplying current to the light source.

Figure 2:
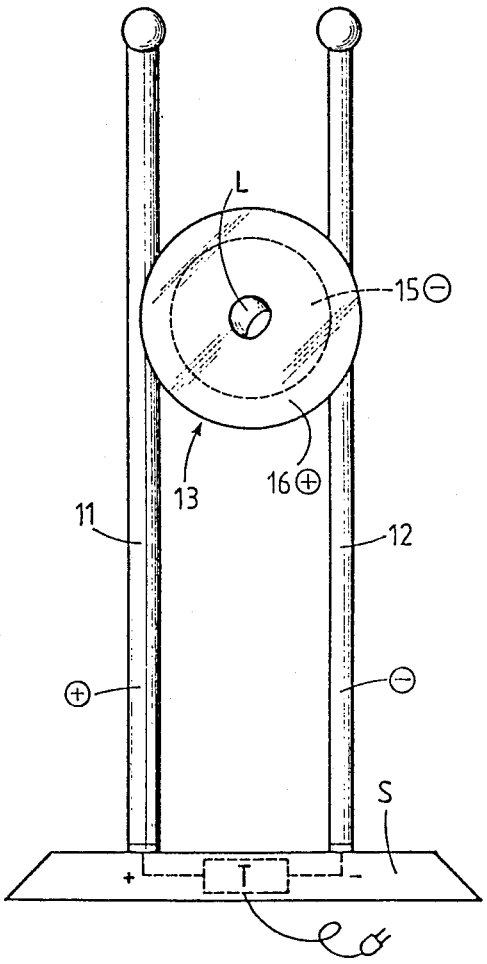
FIGS. 2 and 3 are views respectively in front elevation and from the side of an embodiment of lighting apparatus according to the invention.
Figure 3:
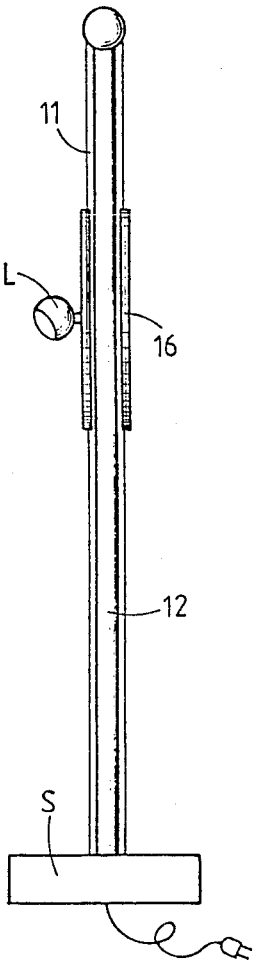

An embodiment of such an application is illustrated in FIGS. 2 and 3, which show a lamp comprising a base S on which are secured vertically and parallel to each other two metallic tubes 11, 12, the diameter of one (11) being greater than that of the other (12), these two tubes serving simultaneously to support the rolling device 13 and as electrical conductors for supplying current to a light source L secured to said rolling device 13. The base S is of an insulating material or is electrically insulated from the two metallic tubes.

In the base S is disposed a transformer T connected to an alternating current source of 220 volts and adapted to supply direct current, for example at a voltage of 12 volts, to supply a halogen lamp L. This lamp L is electrically connected by conventional non-illustrated means, on the one hand to one of the outer rollers 16 and on the other hand to the axle of rotation, insulated from the outer roller 16 by the bearings of insulating material, but in electrical contact with the central roller 15 mounted on this axle by means of steel ball bearings. The respective inner and outer rollers 15 and 16 are of conductive material and are in direct contact with the slideway 12 of small diameter and the slideway 13 of large diameter, respectively.

According to a non-illustrated modification, the tubes 11, 12 of circular section can be replaced by tubes of which only the portion of each slideway confronting the other slideway has a cylindrical wall. Moreover, a blocking member can be mounted on the rolling device 13 to ensure maintaining the vertical position of the latter on the slideways-supports 11, 12.

For other analogous uses, the two tubes serving as slideways-supports may be replaced by metal cables suspended from or even fixed to the ceiling or a wall, as known rails for spotlights. It is accordingly thus possible, by utilizing the assembly according to the invention, to provide lighting devices comprising an element which is displaceable and adapted to have an original aesthetic appearance, such as that described above by way of example.

I claim:

1. Assembly comprising rolling means and two parallel guiding slideways, characterized by the fact that the slideways are constituted by elements of which at least the confronting external walls are cylindrical, the radius of the cylindrical wall of one of these elements being greater than that of the other, and by the fact that the rolling device comprises a rotation axle perpendicular to the plane of the two slideways and mounted for movement in parallelism thereto, a central roller freely rotatably mounted on said axle and whose diameter is such that it will be in rolling contact with the slideway having the cylindrical wall of smaller radius, but out of contact with the other slideway, and two outer rollers mounted freely rotatably on said axle on each side of the central roller, and whose peripheral internal surface has a concave groove in rolling contact with the slideway having the cylindrical wall of greater radius but out of contact with the other slideway.

* * * * *